US005181502A

United States Patent [19]

Ray

[11] Patent Number: 5,181,502

[45] Date of Patent: Jan. 26, 1993

[54] ARROW GUIDE APPARATUS

[76] Inventor: Paul E. Ray, 5111 Wildwood Road, Pascagoula, Miss. 39581

[21] Appl. No.: 740,718

[22] Filed: Aug. 6, 1991

[51] Int. Cl.[5] ..... F41B 5/00

[52] U.S. Cl. ..... 124/44.5; 124/24.1

[58] Field of Search ..... 124/23.1, 24.1, 44.5

[56] References Cited

U.S. PATENT DOCUMENTS

| | | | |
|---|---|---|---|
| 4,686,956 | 8/1987 | Troncoso | 124/44.5 |
| 4,759,337 | 7/1988 | Suski | 124/24.1 |
| 4,838,237 | 6/1989 | Cliburn | 124/44.5 |
| 5,025,773 | 6/1991 | Hintze et al. | 124/44.5 |
| 5,070,855 | 12/1991 | Troncoso | 124/44.5 |

*Primary Examiner*—Randolph A. Reese
*Assistant Examiner*—John A. Ricci
*Attorney, Agent, or Firm*—Leon Gilden

[57] ABSTRACT

An apparatus wherein a mounting plate is fixedly secured to an exterior side wall of a handle riser section of an associated archery bow. The mounting plate includes a support leg extending orthogonally to the mounting plate and above an arrow rest ledge orthogonally oriented relative to the handle riser section. A plurality of arcuate guide legs converge with one another defining a gap therebetween, wherein an alignment leg mounted to the mounting plate is positioned above the guide legs to guide an arrow between the guide legs and the alignment leg.

5 Claims, 4 Drawing Sheets

ARROW GUIDE APPARATUS

BACKGROUND OF THE INVENTION

1. Field of the Invention

The field of invention relates to archery apparatus, and more particularly pertains to a new and improved arrow guide apparatus wherein the same is arranged to provide guidance and alignment of an arrow in an archery environment to maintain the arrow within the guide structure permitting rotation of the bow relative to an individual to maintain the arrow in alignment relative to the bow minimizing visual observation of the arrow prior to its ejection from the bow.

2. Description of the Prior Art

Archery apparatus to provide guidance of arrows is available in the prior art and exemplified by U.S. Pat. No. 4,865,007 to Saunders wherein an arrow rest includes a plurality of guide surfaces in confrontation relative to one another relative to a handle riser section of an archery bow.

U.S. Pat. No. 4,573,445 to Webb, et al. sets forth a tubular conduit utilized with a slingshot arrangement to provide guidance of an arrow.

U.S. Pat. No. 4,911,137 to Troncoso wherein a centering device is provided defined by a generally "U" shaped bracket to maintain alignment of the arrow prior to its release from the associated archery bow.

As such, it may be appreciated that there continues to be a need for a new and improved arrow guide apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of archery apparatus now present in the prior art, the present invention provides an arrow guide apparatus wherein the same provides for a trio of legs converging towards one another to provide guidance and positioning of an archery arrow relative to an archery bow. As such, the general purpose of the present invention, which will be described subsequently in greater detail, is to provide a new and improved archery guide apparatus which has all the advantages of the prior art archery apparatus and none of the disadvantages.

To attain this, the present invention provides an apparatus wherein a mounting plate is fixedly secured to an exterior side wall of a handle riser section of an associated archery bow. The mounting plate includes a support leg extending orthogonally to the mounting plate and above an arrow rest ledge orthogonally oriented relative to the handle riser section. A plurality of arcuate guide legs converge with one another defining a gap therebetween, wherein an alignment leg mounted to the mounting plate is positioned above the guide legs to guide an arrow between the guide legs and the alignment leg.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved arrow guide apparatus which has all the advantages of the prior art archery apparatus and none of the disadvantages.

It is another object of the present invention to provide a new and improved arrow guide apparatus which may be easily and efficiently manufactured and marketed.

It is a further object of the present invention to provide a new and improved arrow guide apparatus which is of a durable and reliable construction.

An even further object of the present invention is to provide a new and improved arrow guide apparatus which is susceptible of a low cost of manufacture with regard to both materials and labor, and which accordingly is then susceptible of low prices of sale to the consuming public, thereby making such arrow guide apparatus economically available to the buying public.

Still yet another object of the present invention is to provide a new and improved arrow guide apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
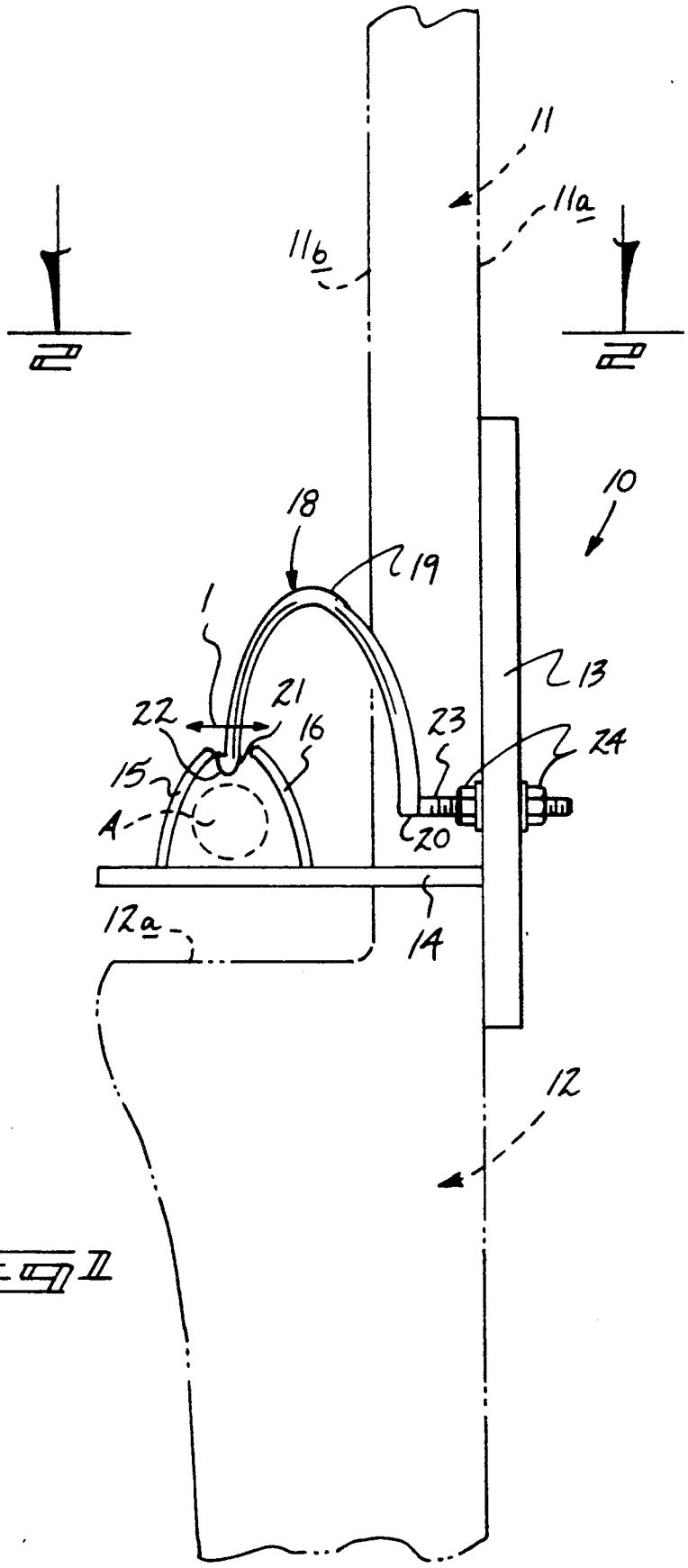
FIG. 1 is an orthographic end view of the apparatus mounted within an archery bow.

With reference now to the drawings, and in particular to FIGS. 1 to 6 thereof, a new and improved arrow guide apparatus embodying the principles and concepts of the present invention and generally designated by the reference numeral 10 will be described.

Figure 2:
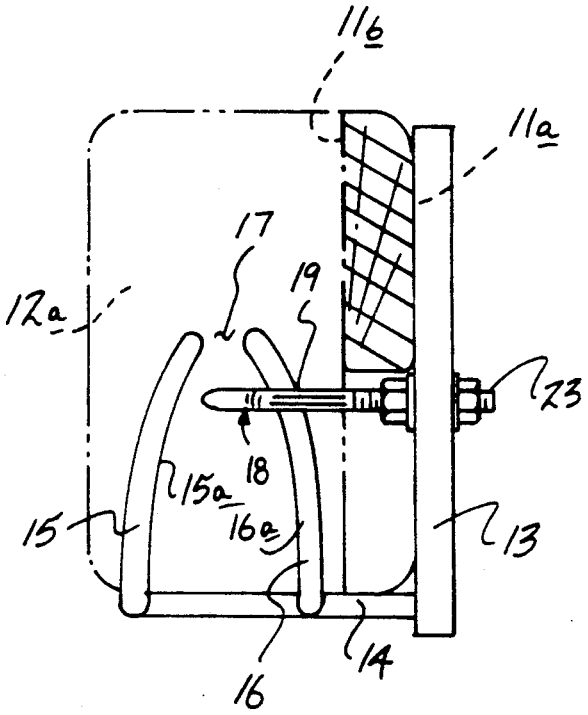
FIG. 2 is an orthographic view, taken along the lines 2—2 of FIG. 1 in the direction indicated by the arrows.

More specifically, the arrow guide apparatus 10 of the instant invention essentially comprises an archery bow 12, including a handle riser section 11, wherein the handle riser section 11 includes a planar exterior side wall 11*a* arranged parallel relative to an interior side wall 11*b* positioned orthogonally relative to an arrow rest ledge 12*a*. The guide apparatus includes a mounting plate 13 fixedly mounted to the exterior side wall 11*a*, with the mounting plate 13 including a mounting plate support leg 14 fixedly and orthogonally mounted to an interior surface of the mounting plate extending in a parallel spaced relationship relative to the arrow rest ledge 12*a* orthogonally relative to the interior side wall 11*b*. The support leg 14 includes a respective first and second arcuate guide leg 15 and 16 fixedly mounted to the support leg 14, wherein each of the arcuate guide legs includes a concave interior surface 15*a* and 16*a* respectively that are in confronting relationship relative to one another, wherein the first and second guide legs 15 and 16 are arranged substantially coextensive relative to one another extending from the support leg 14. A guide leg gap 17 is defined between forward free terminal ends of the guide legs 15 and 16, as illustrated in FIG. 2 for example. An alignment leg 18 is fixedly mounted to the mounting plate 13 extending beyond the interior side wall 11*b* over the arrow rest ledge 12*a* and positioned medially between the first and second guide legs 15 and 16 adjacent the guide leg gap 17. The alignment leg 18 includes a "U" shaped central body 19, including a first body end 20, wherein the first body end 20 integrally mounts a threaded rod 23 that is orthogonally directed through the mounting plate 13 to include fastener members 24 mounted to each side of the mounting plate 13 and provide lateral adjustment of the alignment leg 18, and more specifically, a body second end 21 to position the body second end 21 medially between the first and second guide legs 15, as indicated in FIG. 1 for example. The second end 21 includes a "U" shaped body extension 22 defining a concave surface in confrontation above the first and second guide legs 15 and 16 to provide for an arcuate surface to form a guide surface for the arrow "A" in its position between the first and second guide legs 15 and 16.

Figure 3:
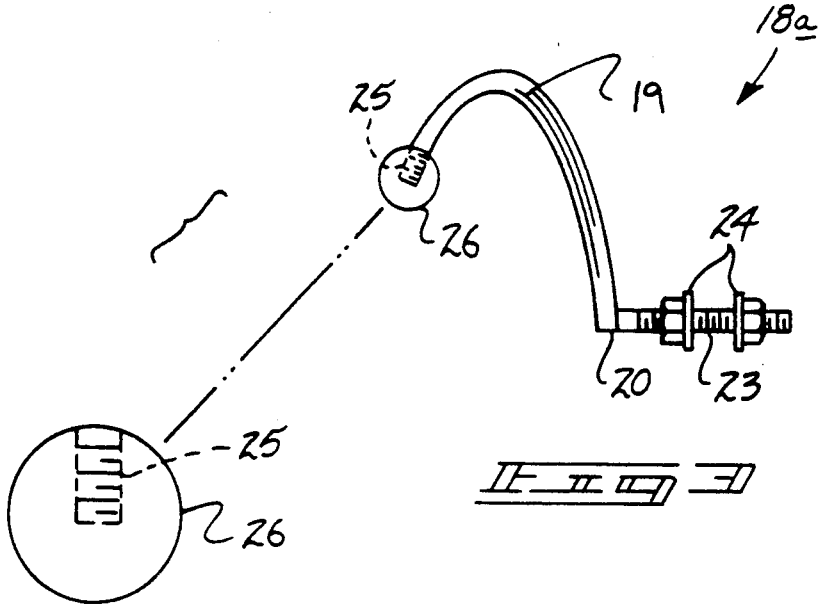
FIG. 3 is an orthographic view, taken in elevation, of a modified alignment leg utilized by the apparatus.
Figure 4:
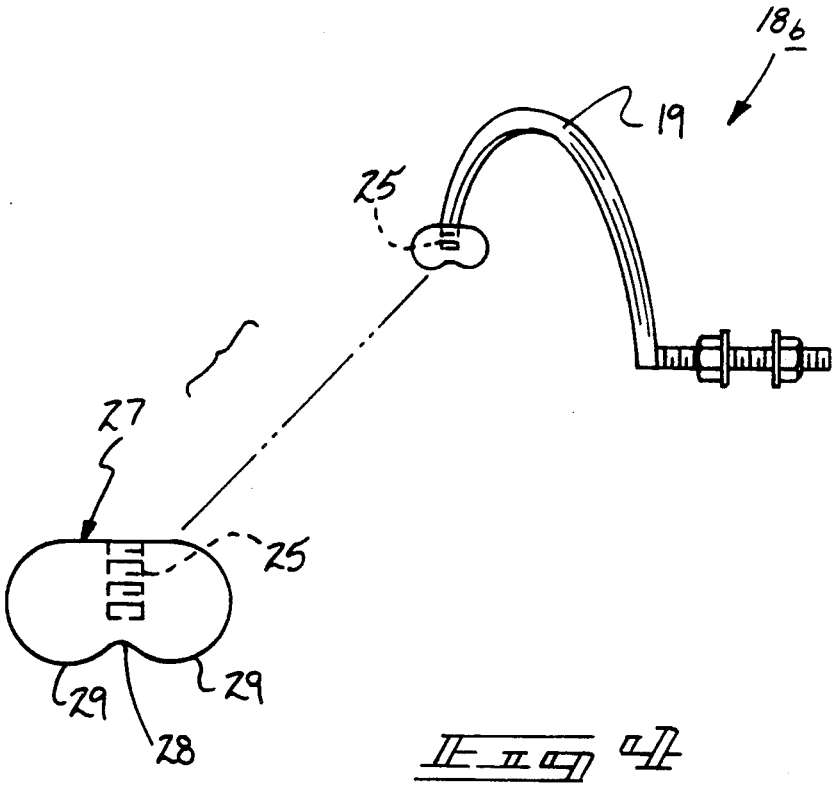
FIG. 4 is an orthographic view, taken in elevation, of a further modified alignment leg utilized by the apparatus.

FIG. 3 illustrates a modified alignment leg 18*a*, to include an externally threaded second end 25 that is positioned above the first end 20, wherein the second end 25 threadedly secures a guide sphere 26 thereto to provide for the requisite arcuate surface providing a guide surface for the arrow "A". The further modified alignment leg 18 includes a guide projection 27 formed with a central groove 28 to a lower surface of the guide projection 27 spaced from the threaded second end 25. The groove 28 is positioned medially between convex arcuate projection nodes 29 to provide an alignment groove for slidably guiding the arrow "A" therewithin in cooperation with the first and second guide legs 15 and 16.

Figure 5:
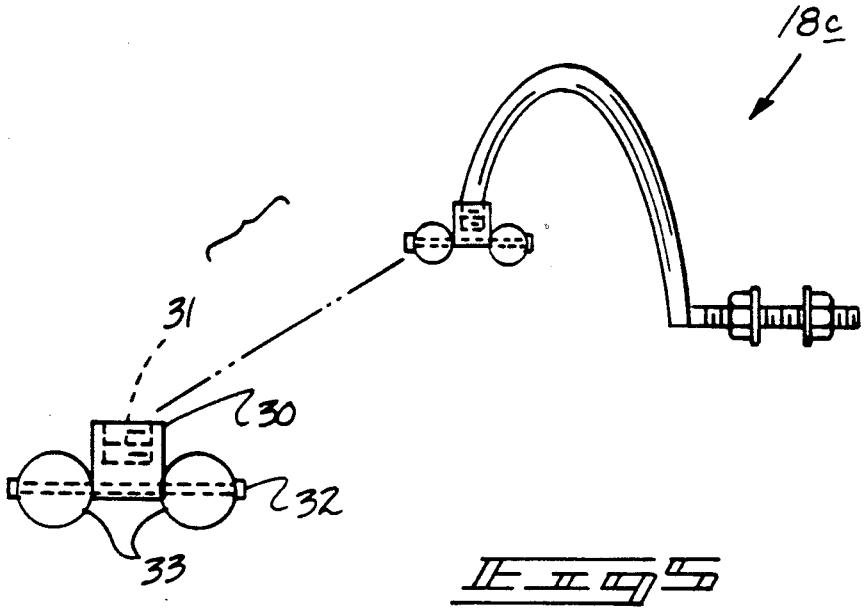
FIG. 5 is an orthographic view, taken in elevation, of a yet further modified alignment leg utilized by the invention.
Figure 6:
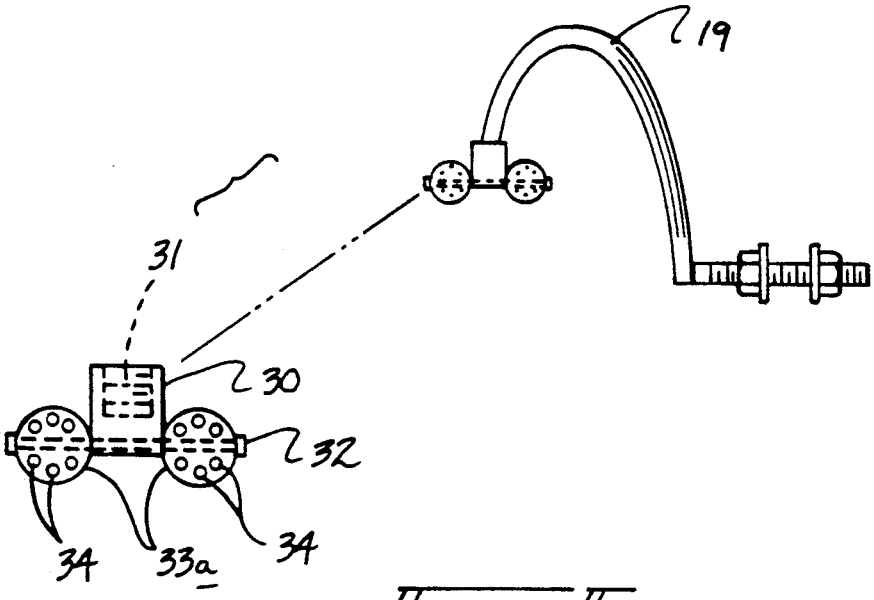
FIG. 6 is the alignment structure of FIG. 5 formed with an audible indicator structure.

FIGS. 5 and 6 illustrate a yet further modified alignment leg 18*c*, wherein a cap member 30 includes an internally threaded cavity 31 threadedly secured to the externally threaded second end 25. The cap member 30 is positioned in a spaced relationship above the first end 20, wherein a cap axle 32 orthogonally oriented relative to the internally threaded cavity 31 is fixedly mounted adjacent a lower end portion of the cap member 30 and rotatably mounts a roller sphere 33 on diametrically opposed sides of the cap member 30. The roller spheres 33 provide for a minimum of friction in guidance of an arrow relative to the cap member 30, wherein the modified spheres 33*a*, as illustrated in FIG. 6, include audible whistle apertures 34 directed through the spheres, whereupon rotation of the spheres upon projection of an arrow, the spheres effect an audible indicator of release of the arrow "A".

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An arrow guide apparatus in combination with an archery bow, wherein the archery bow includes a handle riser section, the handle riser section including an exterior side wall spaced from and parallel an interior side wall, and an arrow rest ledge defined by the handle riser section orthogonally oriented relative to the handle riser section at a lower terminal end thereof, and a mounting plate fixedly mounted to the exterior side wall, the mounting plate including a support leg integrally mounted to the mounting plate extending orthogonally relative to the mounting plate in a spaced relationship above the arrow rest ledge, the support leg including a first arcuate guide leg and a second arcuate guide leg fixedly mounted to the support leg extending above the support leg and the arrow rest ledge adjacent the interior side wall, wherein the first and second arcuate guide legs each define a concave interior surface in confrontation relative to one another, and the first and second arcuate guide legs are coextensive relative to one another, and the first and second arcuate guide legs define a guide leg gap therebetween, wherein the guide leg gap is defined between a respective first and second free terminal end of the respective first and second arcuate guide legs spaced from the support leg, and an alignment leg fixedly mounted to the mounting plate, wherein the alignment leg extends above the gap medially thereof, and the alignment leg includes a central "U" shaped body projecting above the support leg, the "U" shaped body including a body first end and a body second end, the body first end oriented below the second end, and the first end including a threaded rod fixedly mounted thereto, the threaded rod orthogonally projecting into the mounting plate, and the threaded rod reciprocatably mounted within the mounting plate in an adjustable relationship, and including a plurality of fastener members securable to the threaded rod to selectively secure the threaded rod relative to the mounting plate.

2. An apparatus as set forth in claim 1 wherein the body second end includes guide means, wherein the guide means is positioned above and medially between the first and second guide legs adjacent the gap.

3. An apparatus as set forth in claim 2 wherein the guide means includes a guide sphere fixedly mounted to the second end.

4. An apparatus as set forth in claim 3 wherein the guide means further includes an internally threaded cap member, the cap member including an internally threaded cavity, and the second end including an externally threaded surface, wherein the externally threaded surface is threadedly received within the internally threaded cavity, and the cap member includes a cap axle orthogonally projecting through the cap member in an orthogonal relationship relative to the internally threaded cavity, the cap axle including the guide sphere and a further guide sphere rotatably mounted thereto, the guide sphere and further guide sphere are oriented on diametrically opposed sides of the cap member.

5. An apparatus as set forth in claim 4 wherein each sphere includes a plurality of audible apertures directed into each sphere to effect an audible signal upon rotation of the spheres upon projection of an arrow from the archery bow.

* * * * *